US009269526B2

(12) United States Patent
Eichhorn et al.

(10) Patent No.: US 9,269,526 B2
(45) Date of Patent: Feb. 23, 2016

(54) X-RAY TUBE

(71) Applicants: Richard Eichhorn, Hirschaid Seigendorf (DE); Christian Hoffmann, Erlangen (DE); Jan Matschulla, Oderwitz (DE); Gia Khanh Pham, Charlotte, NC (US)

(72) Inventors: Richard Eichhorn, Hirschaid Seigendorf (DE); Christian Hoffmann, Erlangen (DE); Jan Matschulla, Oderwitz (DE); Gia Khanh Pham, Charlotte, NC (US)

(73) Assignee: Siemens Aktiengesellschaft, München (DE)

( * ) Notice: Subject to any disclaimer, the term of this patent is extended or adjusted under 35 U.S.C. 154(b) by 206 days.

(21) Appl. No.: 13/737,855

(22) Filed: Jan. 9, 2013

(65) Prior Publication Data

US 2013/0177137 A1 Jul. 11, 2013

(30) Foreign Application Priority Data

Jan. 10, 2012 (DE) ..... 10 2012 200 249

(51) Int. Cl.
*H01J 35/16* (2006.01)
*H01J 35/26* (2006.01)

(52) U.S. Cl.
CPC ..... *H01J 35/16* (2013.01); *H01J 35/165* (2013.01); *H01J 35/26* (2013.01); *Y10T 156/1043* (2015.01)

(58) Field of Classification Search
USPC ..... 378/121, 122, 123, 124, 134, 135, 136, 378/210
See application file for complete search history.

(56) References Cited

U.S. PATENT DOCUMENTS

| | | | | |
|---|---|---|---|---|
| 6,798,865 | B2 | 9/2004 | Tang | |
| 7,783,012 | B2 | 8/2010 | Cao et al. | |
| 2004/0094326 | A1* | 5/2004 | Tang | H01J 35/025 174/137 B |

FOREIGN PATENT DOCUMENTS

| | | | |
|---|---|---|---|
| CN | 1702780 | A | 11/2005 |
| CN | 102057447 | A | 5/2011 |
| DE | 3149677 | A1 | 6/1983 |
| DE | 4209377 | A1 | 9/1993 |
| DE | 10353176 | A1 | 5/2004 |
| DE | 10 2009 043 892 | A1 | 4/2010 |

OTHER PUBLICATIONS

German Office Action dated May 23, 2012 for corresponding German Patent Application No. DE 10 2012 200 249.9, with English translation.

Kuffel E., et al., "High Voltage Engineering-Fundamentals," Newnes 2000, pp. 1-552 (2000).

Chinese Office Action for related Chinese Application No. 201310003612.1, dated Aug. 5, 2015, with English Translation.

* cited by examiner

*Primary Examiner* — Nicole Ippolito
(74) *Attorney, Agent, or Firm* — Lempia Summerfield Katz LLC

(57) ABSTRACT

An X-ray tube includes a vacuum-filled housing and an anode contained in the vacuum-filled housing. The anode is operable to produce an X-ray beam based on electrons emitted from a cathode and attracted by a high voltage applied to the anode. The X-ray tube also includes a high-voltage power line introduced from an external side of the housing for supplying the anode with a high-voltage potential. The X-ray tube includes an electrical feed for electrically insulating the high-voltage power line from the housing. The electrical feed in the X-ray tube includes at least two insulating layers radially between the high-voltage power line and the housing. The at least two insulating layers are separated from one another by a metallic coating.

15 Claims, 5 Drawing Sheets

X-RAY TUBE

This application claims the benefit of DE 10 2012 200 249.9, filed Jan. 10, 2012, which is hereby incorporated by reference.

BACKGROUND

The present embodiments relate to an X-ray tube.

An X-ray tube is known from DE 42 09 377 A1.

In this X-ray tube, an electrical feed is provided for guiding a cathode and/or anode-side high-voltage power supply into an earthed housing of the X-ray tube.

The electrical feed includes an insulating material that separates the potential difference between the high-voltage power supply and the earthed housing of the X-ray tube without electrical discharges occurring between the high-voltage power line and the earthed housing via the insulating material or the surrounding medium. Such electrical discharges may occur through the insulating material when this disrupts electrically (e.g., when the voltage between the high-voltage power line and the earthed housing of the X-ray tube is larger than a disruptive voltage defined by the disruptive strength of the insulating material).

Such an electrical feed for an X-ray tube is proposed, for example, in DE 31 49 677 A.

SUMMARY AND DESCRIPTION

The present embodiments may obviate one or more of the drawbacks or limitations in the related art. For example, the known X-ray tube may be improved.

The electrical feed may be embodied as an axially controlled feed.

A high-voltage potential guided through the high-voltage power line is a direct voltage potential that, however, is provided for producing current in the X-ray tube over comparatively small periods of time. Therefore, the high-voltage potential is only switched on for these short periods of time, such that the high-voltage potential lasts several seconds or minutes. Since the considered time intervals are very short compared to the relaxation times of the materials used (e.g., feed and surrounding media), a stationary status is not practically achieved in the insulating layer for clean direct voltage exposure.

Therefore, the insulating layer of the electrical feed is not configured onto a direct voltage exposure, but rather onto an alternating voltage exposure or a combination of the two. This may be achieved by a controlled electrical feed, where metallic coatings insulating from one another are attached and coiled together. If the cylinder produced is placed around the high-voltage power line, the cylindrical metallic coatings function just like control coatings around the high-voltage power line that guides the high-voltage potential, where the potential in the individual metallic coatings from the capacitive coupling of the individual metallic coatings is adjusted to each other. In a symmetrical construction, a consistent voltage relief AU would be produced per metallic coating.

This consistent voltage relief AU reduces a voltage drop that may increase in a disproportionately high manner between the earthed housing and the high-voltage line to the edges of a single insulating layer due to surface currents occurring in alternating voltages. This disproportionately high voltage drop may lead to damaging edge discharges and thus to localised electrical degradation of the insulating layer, which may lead to a drastic decrease in the disruptive strength of the insulating material used, such that the entire electrical feed is eventually destroyed. Therefore, the dipping voltage on the insulating layer is dispersed more consistently over the uncovered surface of the insulating layer by the insertion of at least one metallic coating in the insulating layer, which leads to improved protection of the electrical feed before destruction due to a voltage failure.

In one embodiment, an X-ray tube includes a vacuum-filled housing, an anode contained in the vacuum-filled housing for producing an X-ray beam based on electrons emitted from a cathode and attracted by a high voltage applied to the anode, a high-voltage power line introduced from an external side of the housing for supplying the anode with a high-voltage potential, and an electrical feed for electrically insulating the high-voltage power line from the housing. The electrical feed includes at least two insulating layers located radially between the high-voltage power line and the housing, which are separated from one another by a metallic coating.

Due to the metallic coating, the electrical feed and the insulating layers may be effectively protected from voltage failures, thus protecting the X-ray tube from being damaged, which improves the reliability of the X-ray tube and reduces maintenance costs of the X-ray tubes.

In one embodiment, the insulating layers have an axial length from the perspective of the high-voltage power line, which radially decreases from the high-voltage power line to the housing. The consideration for this development is that high field strengths at a boundary surface between the insulating layer and a surrounding medium may lead to voltage flashovers. Such voltage flashovers may be avoided by sufficiently large creep distances. Such voltage flashovers on the aforementioned boundary surface may occur in voltages between the earthed housing and the high-voltage power line, which are clearly lower than the disruptive voltage of the insulating material used in the electrical feed.

So as to effectively avoid the aforementioned voltage flashovers, the field strengths are homogenized along the creep distance. High field strengths are therefore avoided, and thus, the inception voltages of discharges are raised, where the creep may be reduced.

The reduction of this route may be achieved by axially decreasing the size of the individual insulating layers on the radial route of the high-voltage power line to the earthed housing. This development also simplifies the production of the electrical feed, since conventional, integrally constructed insulating layers have extremely complex structures or geometries, so as to minimise the aforementioned creep distances. This leads to voluminous and cost-intensive solutions in the production of the electrical feeds for X-ray tubes. Therefore, the development additionally saves space and costs in the production of the specified X-ray tube.

In one embodiment, the metallic coating is completely embedded between the insulating layers.

In another embodiment, the one material of the insulating layer is inorganic. The consideration for this embodiment is for the electrical feed to seal the housing vacuum-tight and protect against voltage flashovers. Therefore, one part of the material of the insulating layer is exposed to the vacuum of the X-ray tube. Accordingly the material is to be high-vacuum-suitable. This provides that the material of the insulating layer is to not emit gas, thereby not reducing the quality of the vacuum. The consideration for this development is for welding and baking processes to be applied during the mounting of the X-ray tube, by which the electrical feed may be exposed to temperatures of up to 600° C. The material of the insulating layer is to withstand these high temperatures without impairment. Inorganic materials are suitable for these specifications.

In one embodiment, the inorganic material of the insulating layer includes a ceramic insulating material. Ceramic insulating materials may be simply produced using Low Temperature Co-fired Ceramics Technology (e.g., LTCC technology).

In one embodiment, a glass proportion is added to the insulating layer including the ceramic insulating material. This enables the glass proportion to reinforce the bond from the metallic coating and the ceramic insulating material in a sintering process at low temperatures of under 1000° C., and still to sinter the glass proportion tightly. Thus, a high-strength connection between the insulating layers and the metallic coating is achieved with comparably low energy expenditure.

In another embodiment, the inorganic material of the insulating layer includes a glass insulating material. Insulating layers with a glass insulating material may be metal-coated for applying the metallic coating locally by applying a metallic film or a metallic layer, and at temperatures that are higher than the glass-transformation temperature, may be warped malleably. Thus, in a heat coiling process, the electrical feed may coil around a carrier and then fuse with the carrier.

In one embodiment, a material of the insulating layers and a material of the metallic coating have an identical expansion coefficient. The occurrence of damages and therefore imperfections due to large temperature increases in the production of the X-ray tube and in the application thereof may thus be avoided, which reduces the disruptive strength of the electrical feed. For example, in the use of ceramic materials as insulating materials in the insulating layers, it is to be provided that no inhomogeneities (e.g., metallic barbs in the metallic coating) or defects such as pores in the insulating layers themselves occur. However, due to unequal expansion coefficients, warping may occur through calorific energy in the electrical feed, which promotes the occurrence of these inhomogeneities and defects in the metallic coating and in the insulating layers.

In one embodiment, the X-ray tube includes a sealing ring between the housing and the insulation device. The sealing ring seals a gap between the housing and the insulation device vacuum-tight. The entry of air into the housing and thus destruction of the vacuum may be prevented by the sealing ring.

In one embodiment, the sealing ring is produced from an alloy including nickel and iron. These alloys, which may additionally also contain cobalt and/or chromium, are known by the commercial name Vacon and may be obtained easily.

In one embodiment, the high-voltage power line is guided in a metallic cylinder in an insulated manner. This metallic cylinder may already be prefabricated with the electrical feed, such that a sealing ring between the electrical feed and the high-voltage power line may be spared. For example, this may be achieved with an insulating layer that is produced from a glass insulator designed as a film, since, as has already been illustrated, the film may be coiled around a carrier, where the carrier itself is now the metallic cylinder guiding the high-voltage power line.

In one embodiment, the material of the metallic cylinder includes a metal-coated glass. The metallic cylinder may be constructed integrally with the electrical feed, where the embedding of the high-voltage power line into the metallic cylinder may also take place during the production of the electrical feed.

In one embodiment, one of the insulating layers is glazed onto the metallic cylinder, such that the metallic cylinder may be produced separately from the electrical feed. A vacuum-tight connection between the metallic cylinder and the electrical feed may be achieved, such that the corresponding sealing ring is spared.

In one embodiment, a method for producing an electrical feed for a specified X-ray tube includes the acts of printing a ceramic green film with a metallic coating, attaching a further ceramic green film onto the printed side of the ceramic green film, rolling the attached ceramic green films into a cylinder, and heating the rolled and attached ceramic green films. The electrical feed of the specified X-ray tube may be produced with high-vacuum-suitable and temperature-resistant materials. As well as saving the space used for the electrical feed, the probability of discharge effects on the boundary layers of the electrical feed during use in the X-ray tube is reduced, since the high electrical field strengths may be targetedly avoided.

In one embodiment, the specified method includes the act of adding glass to the ceramic green film, which enables the act of heating the rolled and attached ceramic green films at lower temperatures to be carried out, since such ceramic green films solidify at lower temperatures.

In another embodiment, the ceramic green film with an edge on both sides in the rolling direction is printed with the metallic coating.

In an additional development, the specified method includes applying a ceramic insulation material onto the edge on both sides, such that the metallic coating is embedded tightly between the insulating layers. This prevents foreign bodies from amassing between the insulating layers and the metallic coating, which may lead to the insulating layers being separated from one another and thus to the electrical feed being damaged.

Developments to the production method may include acts that carry out the features of the specified X-ray tube and, for example, the electrical implementation thereof.

DETAILED DESCRIPTION OF THE DRAWINGS

Figure 1:
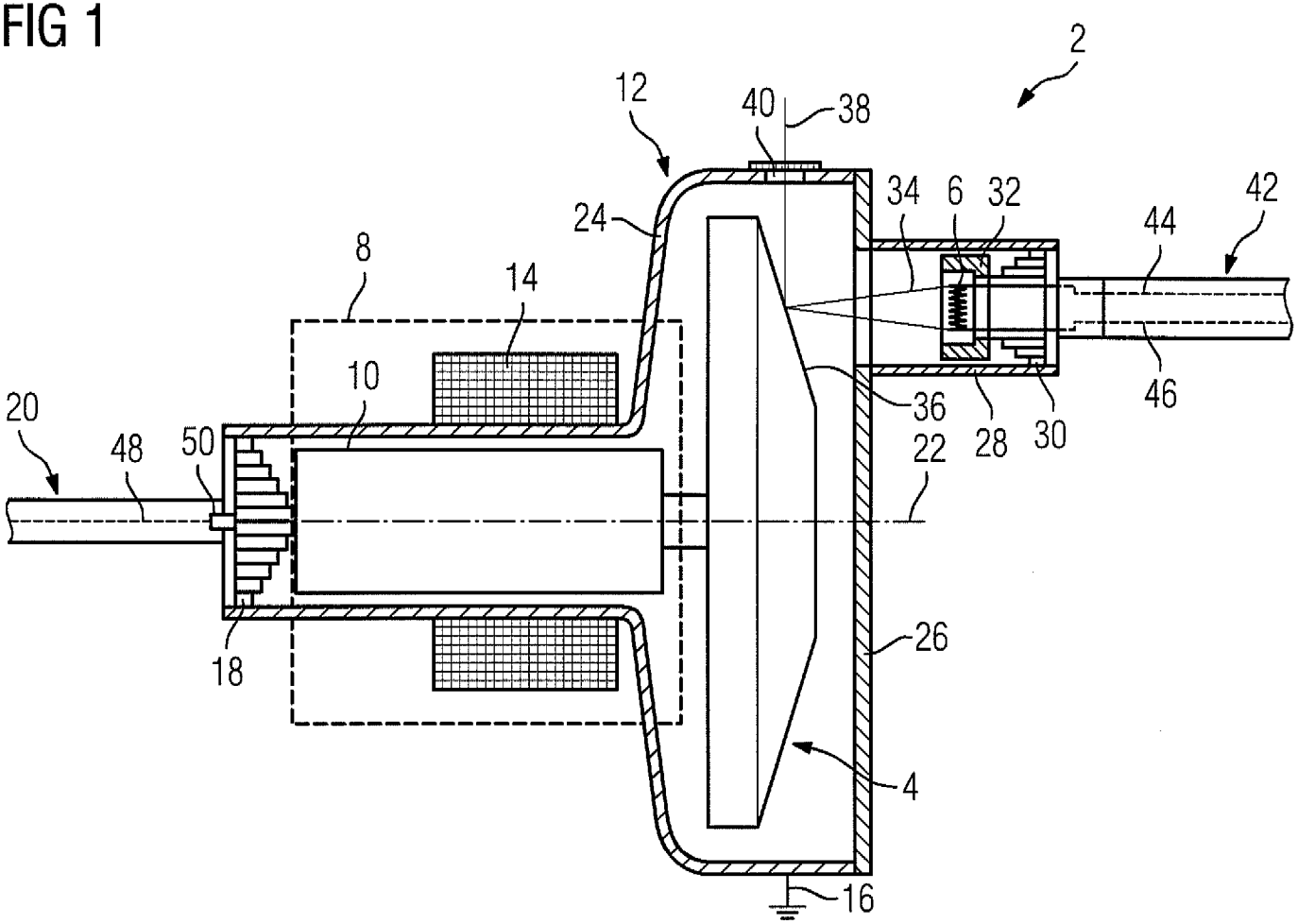
FIG. 1 shows one embodiment of an X-ray tube.

In the following description, the same elements have the same reference numerals and are only described once.

FIG. 1 shows one embodiment of an X-ray tube 2.

The X-ray tube 2 is configured as, for example, a rotating-anode X-ray tube and has an anode plate 4, a hot cathode 6 and a motor 8 for driving the anode plate 4.

The motor 8 may be configured as a squirrel-cage rotor and has a rotor 10 connected to the anode plate 4 so as to prevent rotation, and a stator 14 attached to a vacuum housing 12 in a region of the rotor 10.

The anode plate 4 and the rotor 10 are mounted rotatably on a first electrical feed 18 inserted vacuum-sealed into the vacuum housing 12 of the X-ray tube 2, through which a first high-voltage power line 20 that places the anode plate 4 onto a high-voltage potential is guided. The first electrical feed 18 is explained below. The anode plate 4 and the rotor 10 are configured rotationally symmetrically relative to a middle axis 22 of the X-ray tube 2. The middle axis 22 is a rotational axis of the anode plate 4 and the rotor 10 together.

The vacuum housing 12 is configured as a metallic housing and has an earth connection 16, via which the vacuum housing 12 may be laid (e.g., earthed or to another reference potential). The vacuum housing 12 includes a funnel-shaped metallic housing section 24, a discoidal metallic housing section 26, and a cylindrical housing section 28. The first electrical feed 18 is inserted into a cylindrical end of the funnel-shaped housing section 24 that has the smaller diameter, which is at least fundamentally configured rotationally symmetrically relative to the middle axis 22. The stator 14 is attached to a first end of the funnel-shaped metallic housing section 24. A second end, which is opposite the first end and has the larger diameter, of the funnel-shaped metallic housing section 24 is sealed off by the discoidal housing section 26. Both may be attached to one another, vacuum-sealed, by soldering. The discoidal metallic housing section 26 has an excentrically arranged opening, along the edge of which the discoidal metallic housing section 26 is attached, vacuum-sealed, to the tubular metallic housing section 28, for example, by soldering. A second electrical feed 30 is inserted, vacuum-sealed, into the tubular metallic housing section 28 bearing the hot cathode 6, which is contained in the focusing slot of a schematically denoted cathode beaker 32. The second electrical feed 32 together with the first electrical feed 18 are explained below.

While the X-ray tube 2 is operational, there is an electron beam 34 emerging from the hot cathode 6 onto a truncated-cone-shaped impact surface 36 of the anode plate 4. An X-ray bundle emerges from the impact point, only one central beam 38 of which is denoted in FIG. 1. The X-ray bundle strikes through a beam-exit window 40 provided in the vacuum housing 12.

For supplying electrical energy to the hot cathode 6, the X-ray tube 2 has a second high-voltage power line 42 including a first connecting lead 44 and a second connecting lead 46 for the hot cathode 6, and being guided, vacuum-sealed, through the second electrical feed into the interior of the X-ray tube.

A third connecting lead 48 is guided in the first high-voltage power line 20, which guides the high-voltage potential for the anode plate 4 and leads to a metallic cylinder 50 that is guided through the first electrical feed 18. The correspondingly negative high-voltage potential for constructing high-voltage from the anode plate 4 to the hot cathode 6 may be applied to the first and/or second connecting lead 44, 46. While the X-ray tube 2 is operational, a heating voltage for the hot cathode 4 is thus applied to the first and second connecting lead 44, 46, while high-voltage may be applied between the third and, for example, the second connecting lead 46, 48.

Figure 2:
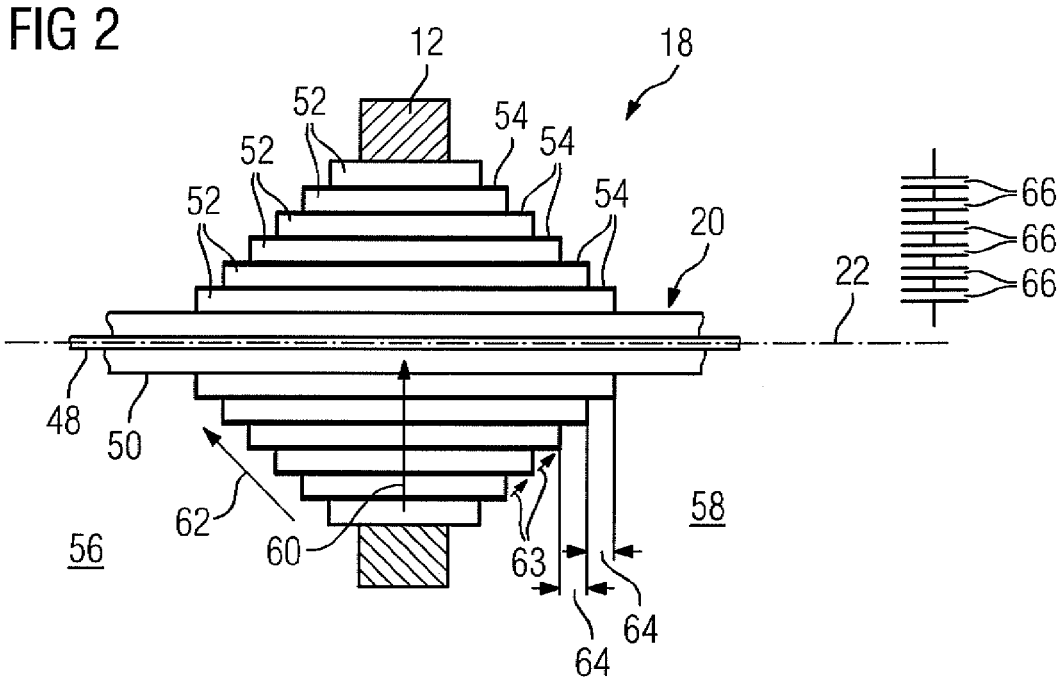
FIG. 2 shows one embodiment of an electrical feed of the X-ray tube from FIG. 1.

FIG. 2 shows one embodiment of the first electrical feed 18 of both electrical feeds 18, 30 of the X-ray tube 2 from FIG. 1.

The electrical feed 18 has six insulating layers 52 that are each separated from one another by a metallic coating 54. On a first side from the perspective of the vacuum housing 12, the electrical feed 18 surrounds a first surrounding medium 56. On a second side from the perspective of the vacuum housing 12, the electrical feed 18 surrounds a second surrounding medium 58. The first surrounding medium 56 may thus be oil for cooling the X-ray tube 2, while the second surrounding medium 58 is a vacuum.

While the vacuum housing 12 lies on a potential of $\Phi_1=0$ through earthing, the third connecting lead 48 guided through the metallic cylinder 50 lies on a high-voltage potential and thus causes a large power failure from the third connecting lead 48 to the vacuum housing 12. The first electrical feed 18 is provided to guide the first high-voltage power line 20 through the earthed 16 vacuum housing 12 without any electrical discharges or any electrical disruptions occurring at the feed position due to this large power failure. The electrical strength of the total electrical feed 18 is to be larger than the internal electrical field strength 60 occurring due to the large power failure between the vacuum housing 12 and the high-voltage power line 20. In addition to the internal electrical field strength 60, high lateral electrical field strengths 62 also occur, however, at the boundary surface between the surface of the insulating layers 52 and the surround medium 56, 58, which may likewise lead to electrical discharges or to electrical disruptions. To avoid these electrical discharges, there is to be a sufficiently large creep distance between the vacuum housing 12 and the high-voltage power line 20 (e.g., a minimal route along the surface of the insulating layers 52 between the vacuum housing 12 and the high-voltage power line 20). Electrical discharges due to the lateral electrical field strength 62 may occur if the internal electrical field strength 60 is still clearly below the electrical strength of the electrical feed 18.

By separating the insulating layers 52 with the metallic coatings 54, a consistent voltage relief 63 from the high-voltage power line 20 to the vacuum housing may occur when there is a symmetrical construction of the insulating layers. This provides that the individual metallic coatings 54 function like capacitances 66 in the electrical feed 18 that are arranged in series in the electrical feed 18. In transient currents, the capacitances 66 allow surface current development at defined points in the electrical feed 18 and thus enable consistent voltage relief 63 within the electrical feed 18. If a transient high-voltage potential is applied to the high-voltage power line 20 (e.g., when switching on direct current between the anode plate 4 and the hot cathode 6), the capacitive control in the electrical feed 18 therefore operates through the metallic coatings, while, during stationary long-term operation, in which the high-voltage potential on the high-voltage power line 20 does not change, the resistive field control has an effect through the insulating materials.

The insulating layers 52 separated from one another by metallic coatings 54 have a defined length difference 64 among themselves, only two of which, for the sake of clarity, are added to a reference numeral in FIG. 2. This defined length difference increases the creep distance and helps to increase the electrical strength of the electrical feed 18 over the lateral electrical field strength 62.

Figure 3:
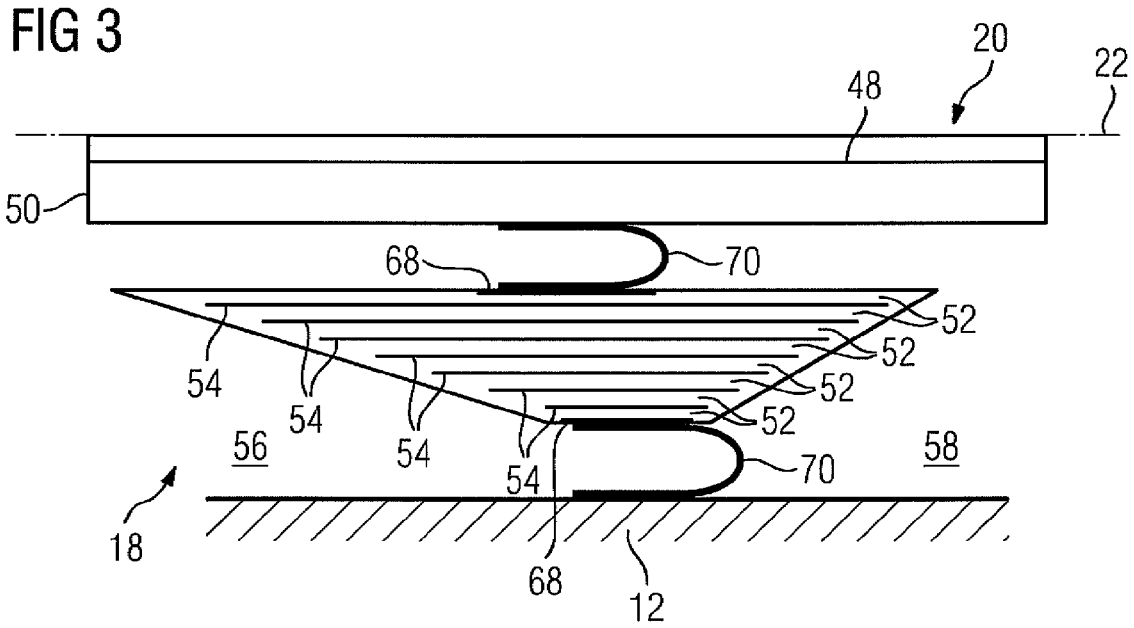
FIG. 3 shows a development of the exemplary electrical feed from FIG. 2.

FIG. 3 shows a schematic depiction of one embodiment of the electrical feed 18 from FIG. 2.

In FIG. 3, one construction of the electrical feed 18, which allows a high-vacuum-suitable assembly in the X-ray tube 2 of FIG. 1, is shown.

The insulating materials of the insulating layers 52 do not emit gas so as to not reduce the quality of the second surrounding medium 58 (e.g., the vacuum). The insulating layers 52, during the mounting of the electrical feed 18 onto the vacuum housing 12, are not affected in terms of function, providing that the insulating layers 52 should withstand welding and baking processes at temperatures of up to 600° C. For this reason, a ceramic material may be provided as a material for the insulating layers 52 of the electrical feed 18 of FIG. 3.

The electrical feed 18 shown in FIG. 3, based on a ceramic material, is produced based on a ceramic multilayer process such as the Low Temperature Co-fired Ceramics Process (hereinafter, "the LTCC process"). In this process, the metallic coatings 54 are first applied to a ceramic green film using a printing technique, which later implements the individual insulating layers 52. The ceramic green films with the metallic coatings 54 applied are then attached and laminated to a multilayer bond by hot pressing.

During the production of the electrical feed 18, inhomogeneities (e.g., metallic barbs) in the metallic coatings 54 and defects (e.g., pores) in the insulating layers 52 are minimized. Due to the high temperature exposure of the electrical feed 18 during assembly into the X-ray tube 2 for the metallic coatings 54 and the insulating layers 52, materials that essentially possess an identical expansion coefficient, such that delamination and tears due to the large change in temperature that may also occur during the operation of the X-ray tube 2 are avoided, may be selected.

In one embodiment, the metallic coatings 54 are implemented as closed. The embedding of the edges of the metallic coatings 54 may take place during the production of the electrical feed 18. Material for the insulating layers 52 is considered accordingly on the edges of the metallic coatings 54. In one embodiment, a long, thin, ceramic green film may thus be metal-coated and coiled as a whole. Thus the coiling may take place according to a fixed procedure, such that a specific number of ceramic layers may be coiled for one insulating layer 52 before a specific number of metallic film layers for a metallic coating 54 are coiled. The procedure is then repeated. The influence of the overlapping metallic coatings 54 is reduced, the radial strength of which may be small in size over the radial strength of an insulating layer 52.

The attachment prepared in this way from the insulating layers 52 and the metallic coatings 54 may be rolled into cylindrical form and solidified by a sintering process. A high-strength connection between the metal-coated ceramic green films and thus between the insulating layers 52 and the metallic coatings 54 is produced.

By adding a comparably low glass proportion to the ceramic green film, the metal-ceramic bond may take place in a sintering process at comparatively low temperatures, such that the electrical feed may already be sintered in a sealed manner at lower than 1000° C.

The axial edges of the electrical feed may be abraded on one or two sides, so that the construction shown in FIGS. 1 to 3 for the ceramic feed is produced.

The electrical feed 18 may be shored in the X-ray tube 2.

A plating 68 is applied to the periphery of the outermost and innermost insulating layer 52 of the electrical feed 18. A vacuum-sealed ring 70 is welded for each between these platings 68 and, accordingly, to the vacuum housing 12 and the high-voltage power line 20, such that the internal space of the vacuum housing 12 is sealed, vacuum-sealed, on the electrical feed 18.

Figure 4:
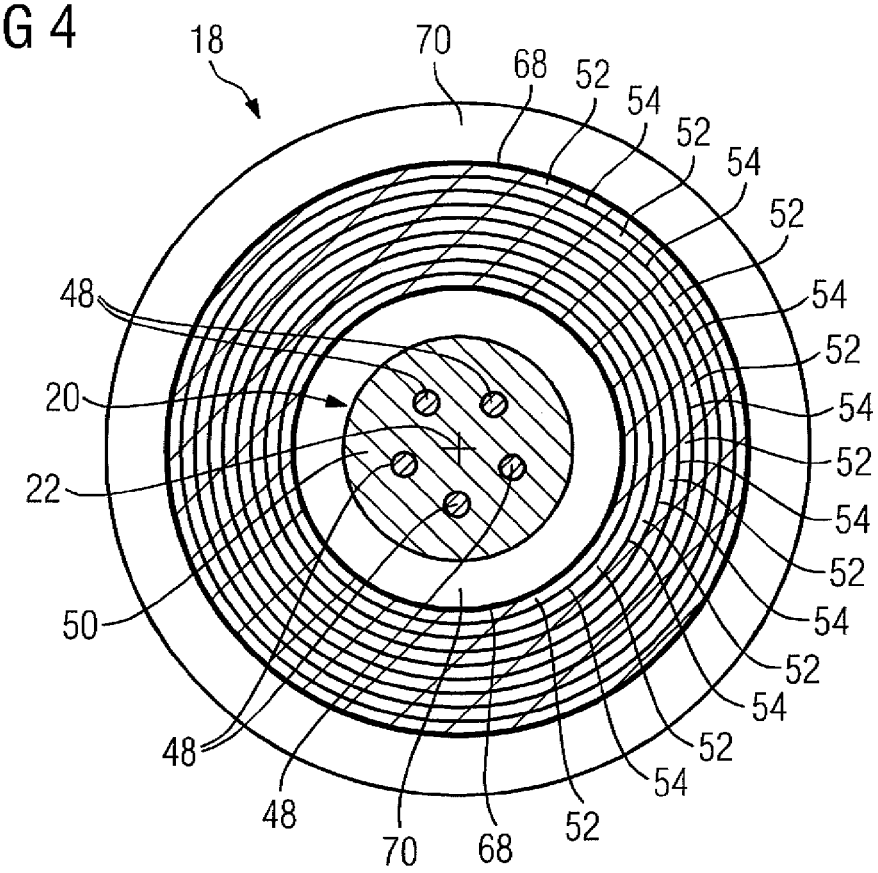
FIG. 4 shows a sectional view of one embodiment of the electrical feed from FIG. 3.

FIG. 4 shows a schematic sectional depiction of one embodiment of the electrical feed 18 from FIG. 3.

As shown in FIG. 4, several connecting leads 48 may also be arranged through the electrical feed 18 for guiding the high-voltage potential for the anode plate 4.

Figure 5:
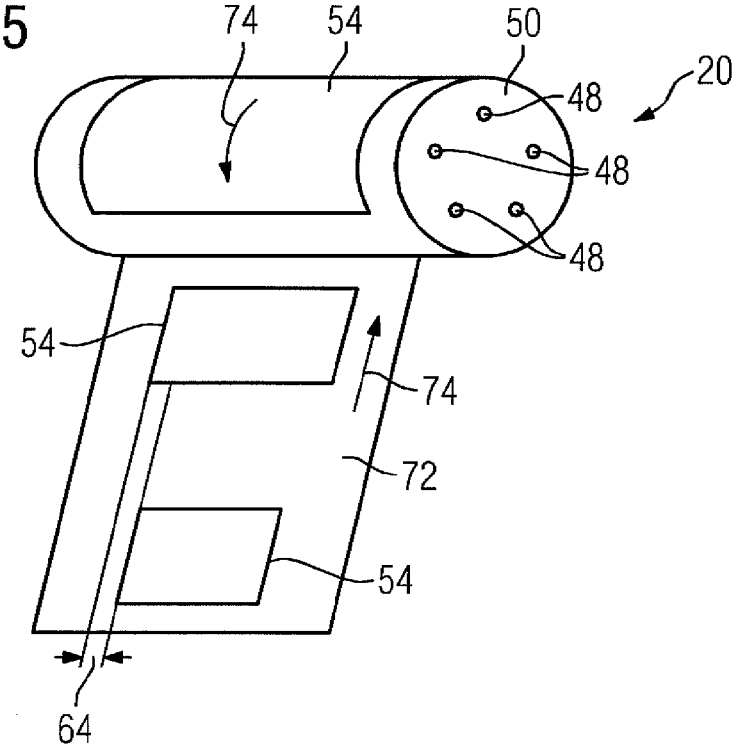
FIG. 5 shows one embodiment of a method for producing the electrical feed of FIG. 3.

FIG. 5 shows an alternative method for producing the electrical feed 18 of FIG. 3.

In this method, glass is used as the material for the insulating layers 52, which fulfils the specifications regarding vacuum-suitability and temperature strength for the assembly of the electrical feed into the X-ray tube 2.

In this method, an insulating glass film 72 is added locally to the metallic coating 54. The glass film 72 metal-coated in this way may be plastically warped at temperatures above the glass-transformation temperature. A metal film or a directly-applied metallic layer may be used for the metallic coating 54.

Glasses with high disruptive strength are used as the material for the glass film 72. These are, for example, alkali-free aluminoborosilicate glasses that, for example, are sold by the Schott company under the trade name AF 45 or AF 32. The glass film 72 shows a disruptive strength of up to 30 kV/mm due to the volume effect during an applied alternating voltage. If direct voltage is applied to the glass film 72, the two to threefold disruptive strength may be achieved.

As is shown in FIG. 5, the metallic coatings 54 are applied directly onto the glass film 72. The length alteration 64 of the layers of the electrical feed 18 may be identified on the metallic coatings 54 shown. Thus, the metallic coatings 54 are thin layers with a layer thickness of between 100 nm and 1 μm. If the platings 68 are directly applied to the glass film 72, methods such as screen printing, galvanisation, sputtering, vacuum deposition or the application of a sol-gel are available for good adhesion of the metal to the glass film 72. A metal film applied directly to the glass film 72 may be fixed using a binding agent such as water.

Before or after the glass film 72 has been added to the metallic coatings 54, the glass film 72 is heated to a temperature above a warping temperature and rolled around the metallic cylinder 50 of the high-voltage power line 42 in the direction 74 shown in FIG. 3. The glass film 72 may first be rolled around any carrier and produced for the electrical feed 18. This, however, may be omitted by coiling up the glass film 72 and by glazing the glass film 72 directly onto the metallic cylinder 50 of the vacuum-sealed ring 70 between the metallic cylinder 50 and the electrical feed 18. If the metallic cylinder 50 is produced from a metal-coated glass cylinder, the total construction may be produced from the high-voltage power line 42 and the electrical feed from a single glass body.

By coiling the glass film 72 onto the metallic cylinder 50, it is technically disadvantageous to embody the metallic coatings 54 as closed, as is shown in FIG. 4. It is technically most advantageous to implement either an open structure according to FIG. 6 or an overlapping structure according to FIG. 7, which is described below.

The edges of the metallic coatings 54 are completely embedded in the glass film 72 during coiling. As well as the metallic coatings 54, an additional film edge made from glass is considered, which is later fused together with the glass film 72.

The glass film 72 is fused, such that the metallic coatings 54 ultimately lie in a glass body implementing the insulating layers 52, which surrounds the metallic coatings 54 free from high voltage and vacuum-sealed.

The edge of the glass body has a non-metal-coated edge that may be thermally warped separately by fusion, for example, after coiling and fusing, so as to implement the slanted axial edges of the electrical feed 18 according to one of FIGS. 1 to 3. Alternatively, the glass body in the electrical feed may also be embodied rectangularly, however, so with even more subsequent insulation axially on the metallic coatings 54. This takes up more space but further reduces the electrical field strengths on the boundary layer.

Figure 6:
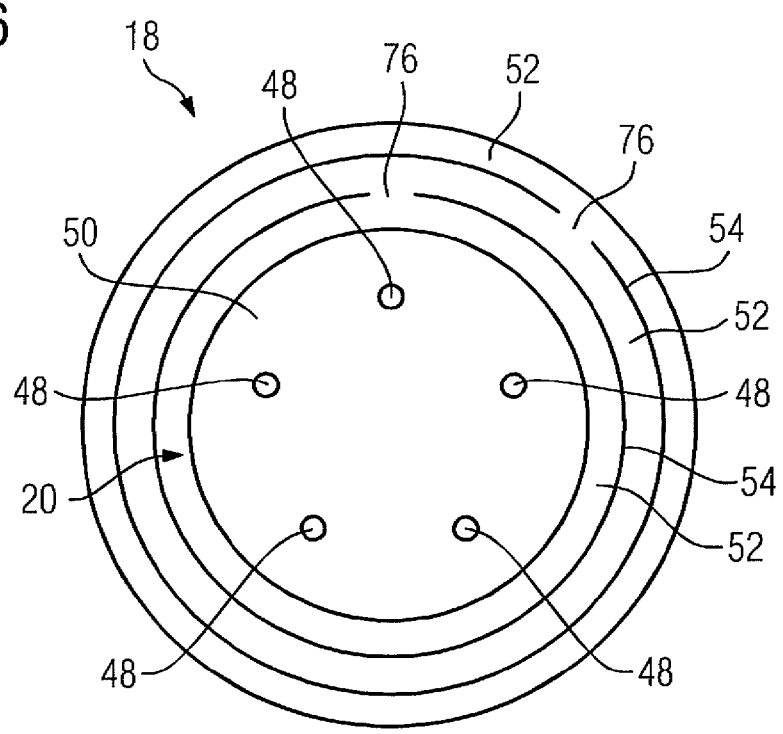
FIG. 6 shows one embodiment of an electrical feed produced by the method from FIG. 5.

FIG. 6 shows a schematic depiction of one embodiment of an electrical feed 18 produced using the method from FIG. 5, where the metallic coatings 54 are configured as open structures.

In the open structure, the metallic coatings 54 are coiled onto each other with an open gap 76. The open gaps 76 may have as small a width as possible and be arranged to dislocate one another.

The dislocated arrangement of the open gaps 76 in the open structure offers the advantage that only minor inhomogeneities occur in the electrical feed 18.

Figure 7:
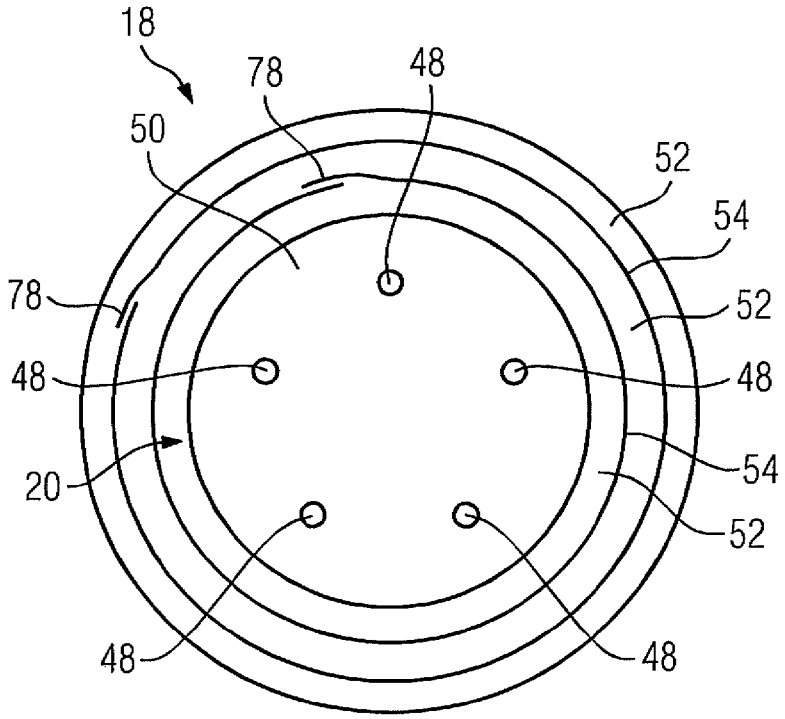
FIG. 7 shows an alternative electrical feed produced by the method from FIG. 5.

FIG. 7 shows a schematic depiction of one embodiment of an electrical feed 18 produced using the method from FIG. 5, where the metallic coatings 54 are configured as overlapping structures.

In the overlapping structure, the metallic coatings 54 with an overlapping region 78 are coiled onto each other, providing that the length of each plating 68 is longer in the coiling direction 74 than the corresponding periphery of the electrical feed 18 in this production stage. An additional insulation is provided due to the edges of the corresponding metallic coatings 54.

In one embodiment, the insulating layer 52 may be radially much thicker (e.g., by a factor of 3) than the radial thickness of the overlap of two metallic coatings 54.

Closed metallic coatings 54 in the electrical feed 18, in which a closed metallic layer is applied to the surface of an individual, coiled glass film 72, may be produced. The next glass film 72 is coiled onto this closed metallic layer, such that the entire electric feed 18 may be produced with closed metallic coatings 54.

Figure 8:
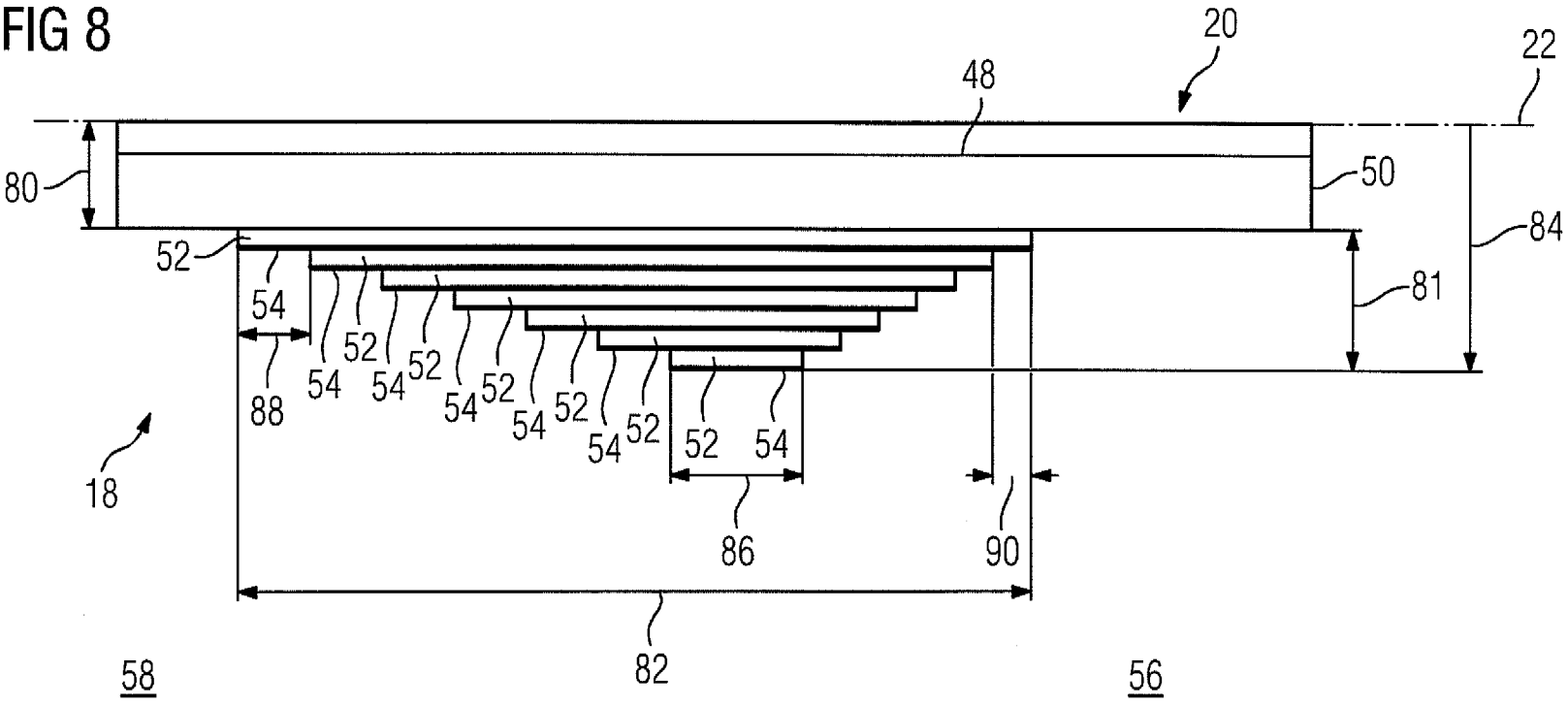
FIG. 8 shows one embodiment of an electrical feed with dimensional specifications.

FIG. 8 shows a schematic depiction of an exemplary electrical feed 18 with dimensional specifications.

In the dimensioned example, a glass film 72 was selected as the insulating material for the insulating layers 52, which were coiled using the above-described heat coiling process for the electrical feed 18. The electrical feed 18 was directly coiled onto the metallic cylinder 50, such that a separate vacuum-sealed ring 70 between the metallic cylinder 50 and the electrical feed is obsolete.

The radius 80 of the high-voltage power line 20 is 16.5 mm, for example. The metallic coatings 54 are coiled with an open structure in the electrical feed 18, where the open gaps 76 each have a width of 200 μm and are arranged to dislocate each other.

The electrical feed 18 has a total of 18 insulating layers 52, where, in FIG. 8, for the sake of clarity, only 7 insulating layers are depicted. The overall radial size 81 of the electrical feed 18 is, for example, 7 mm. There is, for example, a diameter 84 of 47 mm for the overall electrical feed.

The insulating layer 52 that is radially the lowest has a length 82 of, for example, 65 mm. This length 86 decreases over the individual insulating layers 52 to the insulating layer 52 that is radially the highest to, for example, 11 mm. On the vacuum side 58, the length of the insulating layers decreases with a length alteration 88 of, for example, 2 mm, while on the oil side 56, the length of the insulating layers decreases with a length alteration 90 of, for example, 1 mm.

The relative permittivity of the individual insulating layers 52 produced from glass film is, for example, 6. Due to the volume effect, the electrical strength of the individual, comparably thin insulating layers 52 is very high, such that electrical field strengths of up to, for example, 30 kV/mm may be securely applied to the individual insulating layers. By using many thin glass films, a high electrical strength of the entire electrical feed 18 is thus achieved.

To avoid undesired discharges on the surface of the electrical feed 18, the maximum axial field strength may be considered, which may be calculated using the inception voltage in each surrounding medium. For vacuum, the admissible empirical value of the axial field strength of, for example, $$\frac{\text{kV}}{3\ \text{mm}}$$

may be reverted to. For oil, the admissible empirical value of the axial field strength of, for example, $$\frac{\text{kV}}{6\ \text{mm}}$$

may be reverted to.

In one embodiment, the high-voltage power line 42 may thus guide an electrical potential of, for example, 108 kV, such that there is a lapse in the voltage difference of 6 kV over each of the 18 insulating layers, which, due to the length alteration 88 of 2 mm on the vacuum side 58 and the length alteration 90 of 1 mm on the oil side 58, do not lead to an undesired discharge between the individual metallic coatings 54 of the insulating layers 52.

Although the invention is illustrated in greater detail by the exemplary embodiments, the invention is not limited by these exemplary embodiments. Other variants may be derived by the person skilled in the art herefrom, without exceeding the scope of the protection of the invention.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An X-ray tube comprising:

a housing that is vacuum-filled;

an anode contained in the housing, the anode operable to produce an X-ray beam based on electrons emitted from a cathode and attracted to high-voltage applied to the anode;

a high-voltage power line introduced from an external side of the housing, the high-voltage power line operable for supplying the anode with a high-voltage potential; and an electrical feed operable for electrically insulating the high-voltage power line from the housing, the electrical feed comprising at least two insulating layers radially between the high-voltage power line and the housing, the at least two insulating layers being separated from one another by a metallic coating, a first insulating layer of the at least two insulating layers radially surrounding a second insulating layer of the at least two insulating layers.

2. The X-ray tube as claimed in claim 1, wherein the at least two insulating layers have an axial length from a perspective of the high-voltage power line, the axial length decreasing radially from the high-voltage power line to the housing.

3. The X-ray tube as claimed in claim 2, wherein the metallic coating is embedded between the at least two insulating layers.

4. The X-ray tube as claimed in claim 2, wherein one material of each insulating layer of the at least two insulating layers is inorganic.

5. The X-ray tube as claimed in claim 4, wherein the inorganic material comprises a glass, a ceramic insulating material, or the glass and the ceramic insulating material.

6. The X-ray tube as claimed in claim 1, wherein the metallic coating is embedded between the at least two insulating layers.

7. The X-ray tube as claimed in claim 1, wherein one material of each insulating layer of the at least two insulating layers is inorganic.

8. The X-ray tube as claimed in claim 7, wherein the inorganic material comprises a glass, a ceramic insulating material, or the glass and the ceramic insulating material.

9. The X-ray tube as claimed in claim 1, wherein one material of the at least two insulating layers and one material of the metallic coating have a same expansion coefficient.

10. The X-ray tube as claimed in claim 1, further comprising a sealing ring between the housing and the electrical feed, the sealing ring operable to seal a gap between the housing and the electrical feed vacuum-sealed.

11. The X-ray tube as claimed in claim 10, wherein the sealing ring is an alloy comprising nickel and iron.

12. The X-ray tube as claimed in claim 1, wherein the high-voltage power line is guided in a metallic cylinder in an insulated manner.

13. The X-ray tube as claimed in claim 12, wherein one material of the metallic cylinder comprises a metal-coated glass.

14. The X-ray tube as claimed in claim 12, wherein one insulating layer of the at least two insulating layers is glazed onto the metallic cylinder.

15. The X-ray tube as claimed in claim 1, wherein the first insulating layer radially surrounds a portion of a length of the second insulating layer.

* * * * *